United States Patent [19]

Stewart

[11] 3,995,555

[45] Dec. 7, 1976

[54] REMOVABLE REDEEMABLE COUPON FOR NEWSPAPER ADVERTISEMENTS AND METHOD AND APPARATUS FOR PRODUCING SAME

[76] Inventor: Frank E. Stewart, 1921 Judson, Manhattan, Kans. 66502

[22] Filed: June 4, 1975

[21] Appl. No.: 583,621

[52] U.S. Cl. ..... 101/426; 101/227; 197/1.5; 428/909

[51] Int. Cl.[2] ..... B41L 15/14

[58] Field of Search ..... 101/224, 226, 227, 220, 101/223; 83/347, 495, 505, 509; 197/1.5, 1.6; 428/909, 911

[56] References Cited

UNITED STATES PATENTS

| | | | |
|---|---|---|---|
| 2,183,722 | 12/1939 | Newman | 83/347 X |
| 2,213,569 | 9/1940 | Rohland | 101/226 X |
| 2,450,312 | 9/1948 | Tollison | 83/347 X |
| 2,469,526 | 4/1949 | Sloat | 83/347 X |
| 2,680,404 | 6/1954 | Royer | 101/223 X |
| 2,741,176 | 4/1956 | Hollis | 101/227 |
| 2,982,208 | 5/1961 | Boyd | 101/407 R |
| 3,065,691 | 11/1962 | Sohn | 101/227 |
| 3,174,428 | 3/1965 | Huck | 101/227 |
| 3,430,560 | 3/1969 | Nettleman | 83/347 X |
| 3,554,070 | 11/1968 | Boyd | 83/347 X |
| 3,779,285 | 12/1973 | Sinibaldo | 83/347 X |

*Primary Examiner*—Edgar S. Burr
*Assistant Examiner*—Paul J. Hirsch
*Attorney, Agent, or Firm*—Fishburn, Gold & Litman

[57] ABSTRACT

A removable redeemable coupon for newspaper advertisements and method and apparatus for producing same wherein the newspaper is printed in a rotary web press having a plurality of pairs of printing plate cylinders and blanket cylinders between which the web moves during the printing process. Printing plates secured in position on printing plate cylinders of certain pairs to print the faces of the web with news and advertisements including display advertisements with a redeemable coupon included therein. A plate having lines of perforating members is positioned on the printing plate cylinder of another pair to register with the boundries of the coupon printed on the web as said coupon passes thereby between the perforating plate and a cushion sheet adhered to the respective blanket cylinder of said another pair, said cushion sheet being larger than the area of the coupon whereby the cushion sheet retains the perforating members from contact with the blanket of the respective blanket cylinder and provides for the perforating plate to perforate the web with only normal impression adjustments, the perforating lines for a coupon being spaced from edges of the web and separation lines for pages.

8 Claims, 4 Drawing Figures

REMOVABLE REDEEMABLE COUPON FOR NEWSPAPER ADVERTISEMENTS AND METHOD AND APPARATUS FOR PRODUCING SAME

This invention relates to advertising in newspapers and the like such as are commonly printed on a web of newsprint fed from a roll into high speed rotary presses and more particularly to the provision of a removable redeemable coupon in the advertisements defined by perforated lines for ease of removal of the coupon from the newspaper page without requiring any cutting instruments such as scissors and the like.

It is common practice in advertising of merchandise, services and the like to use display advertising in newspapers and it has been found desirable to have coupons which are redeemable and/or return mailers which can be mailed to the advertiser for merchandise, services or information as indicated in the respective advertisement. In order to have return mailers, it is the usual practice to provide separate inserts of relatively heavy paper which are printed and formed entirely separate from the newspaper and then it is inserted between folds of the newspaper before delivery to the customer. The advertising and coupon in the insert is more expensive due to the additional cost of the paper, the additional cost of handling and in the printing process over the cost of a newspaper with such a coupon.

The principal objects of the present invention are: to provide a newspaper page carrying display advertising and other advertising and/or news items with a redeemable coupon and/or return mailer defined by lines of perforation so the coupon and/or return mailer will be readily removable from the newspaper page; to provide a method and apparatus for producing removable redeemable coupons in newspapers for forming the coupon during printing of the newspaper in a rotary web press; to provide in a rotary web press for newspaper printing, printing plates on certain printing plate cylinders to print the faces of the web with news and advertisements including display advertisements with a redeemable coupon included therein with an additional plate having lines of perforating members on an uninked printing plate cylinder and a cushion sheet adhered to a respective blanket cylinder in registry with the perforating members to be engaged thereby; to provide such an apparatus and method wherein the cushion member is resilient material such as rubber, neoprene or the like and of a thickness to provide for the perforating plate to perforate the web with only normal impression adjustments; and to provide a method and apparatus for forming removable redeemable coupons and/or return mailers in newspapers as they are printed in high speed rotary web presses; and to provide a method and apparatus of producing removable redeemable coupons for newspaper advertisements which is economical, efficient, and which provides substantially no interference with normal newspaper printing in high speed rotary web presses.

Other objects and advantages of the present invention will become apparent from the following description taken in connection with the accompanying drawings wherein are set forth by way of illustration and example certain embodiments of the present invention.

Figure 1:
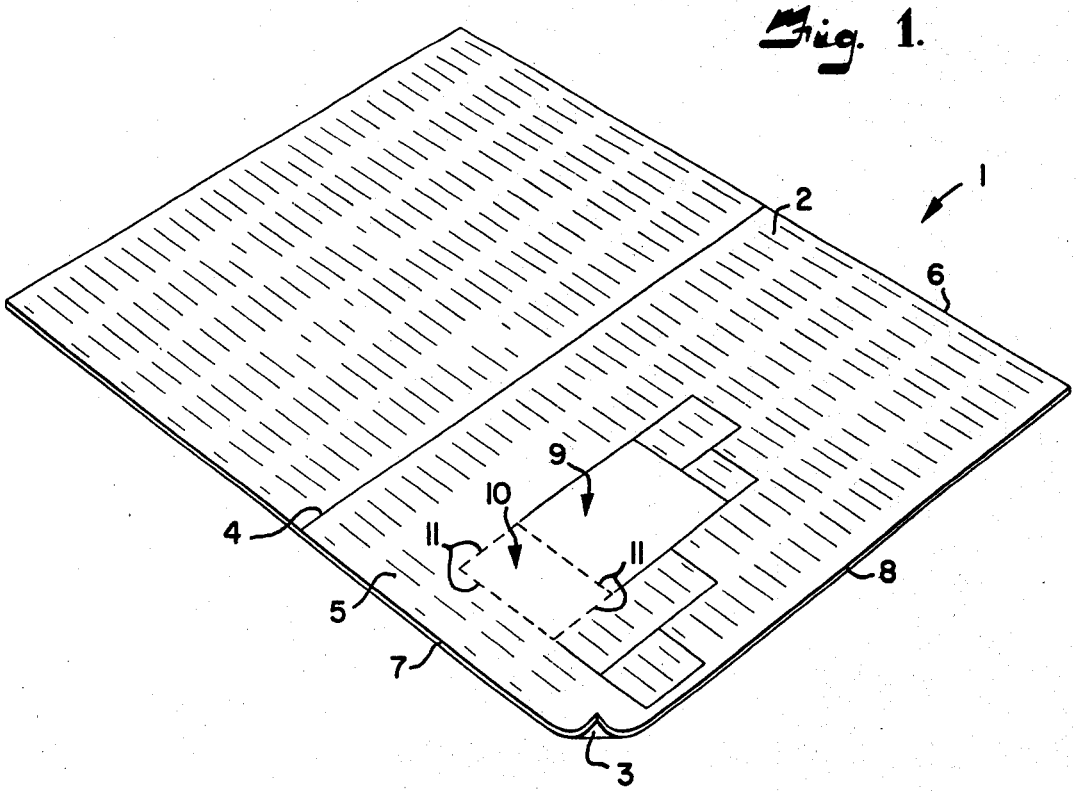
FIG. 1 is a perspective view of a portion of a newspaper page showing a removable redeemable coupon therein.
Figure 2:
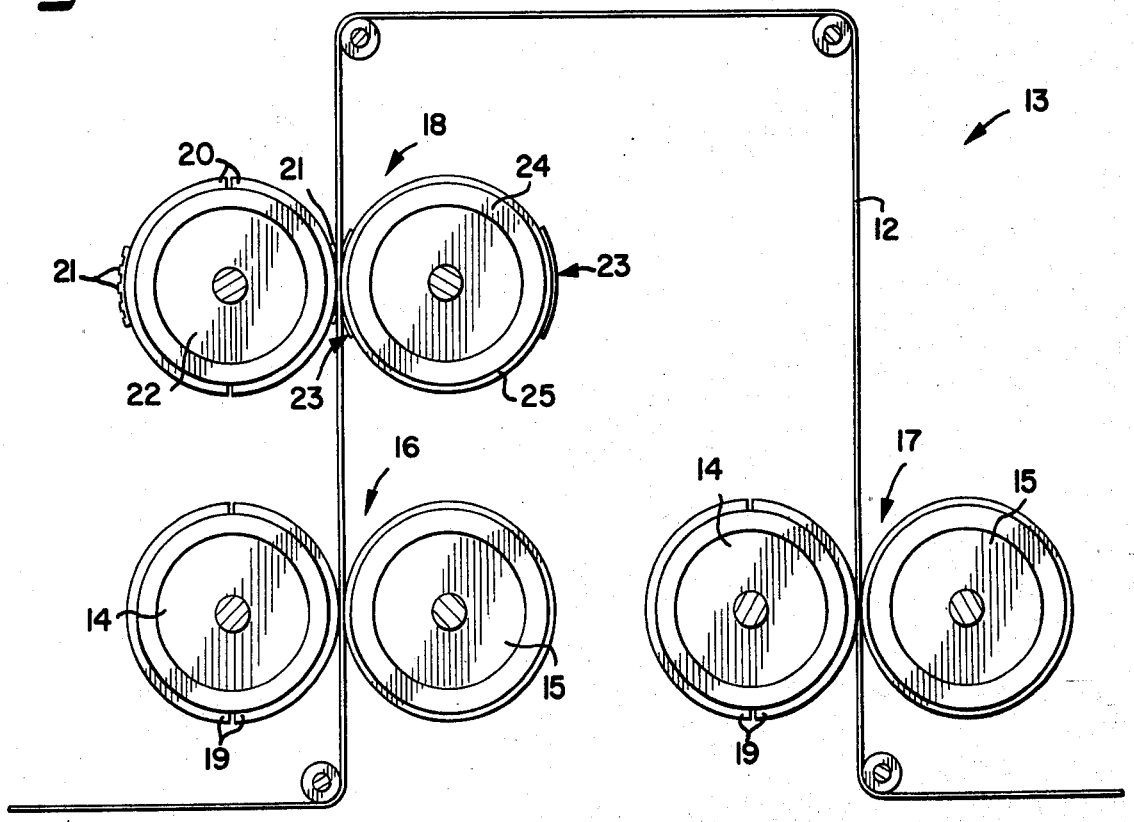
FIG. 2 is a diagramatic sectional view showing a web passing between printing and blanket cylinders and a perforating cylinder and a respective blanket cylinder having a protective pad positioned thereon.
Figure 3:
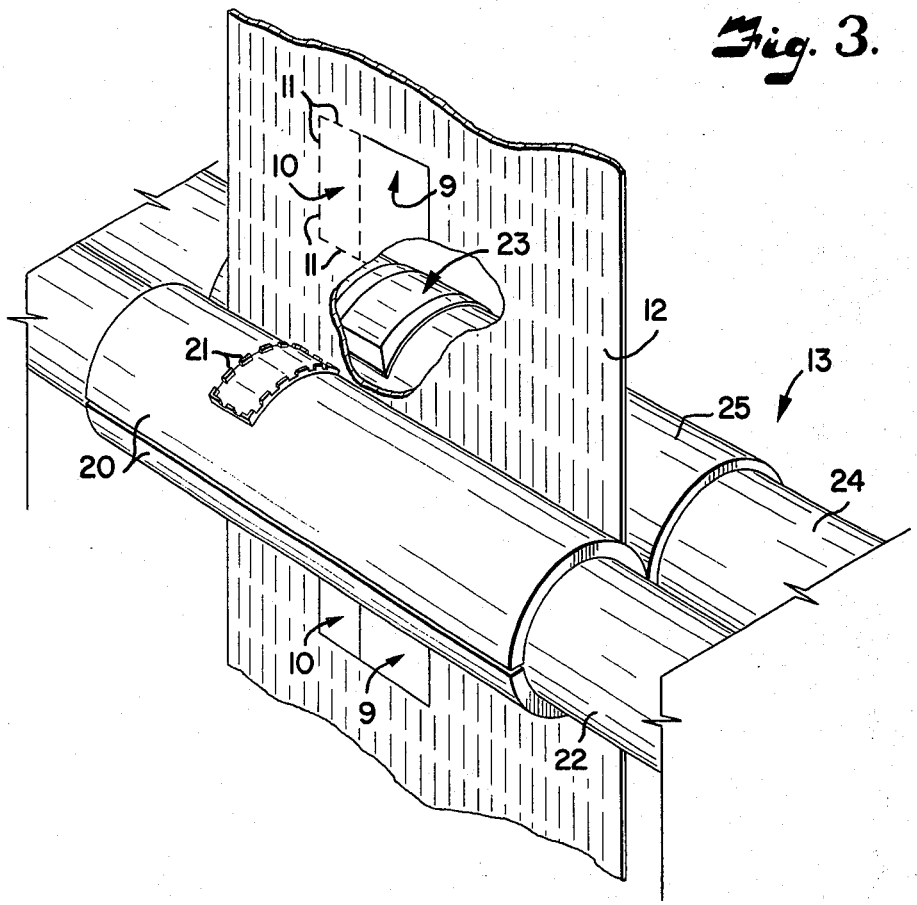
FIG. 3 is a partial perspective view of a printing cylinder with a perforating plate and a blanket cylinder with a protective pad thereon.

Referring more in detail to the drawings:

As required, detailed embodiments of the present invention are disclosed herein, however, it is to be understood that the disclosed embodiments are merely exemplary of the invention which may be embodied in various forms. Therefore, special structural and functional details disclosed herein are not to be interpreted as limiting but merely as a basis for the claims and as a representative basis for teaching one skilled in the art to variously employ the present invention in virtually any appropriate manner.

The reference numeral 1 generally designates a newspaper sheet having a front face 2 and a back face 3 with a fold line 4 extending thereacross thereby the sheet forms a conventional folded newspaper sheet with one portion 5 when printed on both the front and back face forming two pages of the newspaper. The portion 5 has top and bottom edges 6 and 7 respectively and a side edge 8 parallel with the fold line 4. The pages of the newspaper may contain news items and/or advertisements and in the illustrated structure the front face of the portion 5 has a display advertisement 9 with a redeemable coupon 10, said coupon having its borders defined by lines of perforations 11 extending therearound. The lines of perforations are spaced from the edges 6, 7 and 8 of the sheet for the purpose later described.

The newspaper sheet 1 is preferably printed in a conventional manner as a part of a web 12 in a high speed rotary web press. It is preferred that the press 13 be of conventional form with a plurality of pairs of printing plate cylinders 14 and blanket cylinders 15. A suitable press is of a type commonly used for color printing, as for example,, one having at least three pairs 16, 17 and 18 of printing plate cylinders and blanket cylinders. The pairs 16 and 17 have the customary printing plates 19 which are inked to provide the first and second impressions in black in the usual way. The pair 18 of cylinders provides the perforating of the web around the coupon printed thereon with no ink being used in said pair 18 of cylinders.

Figure 4:
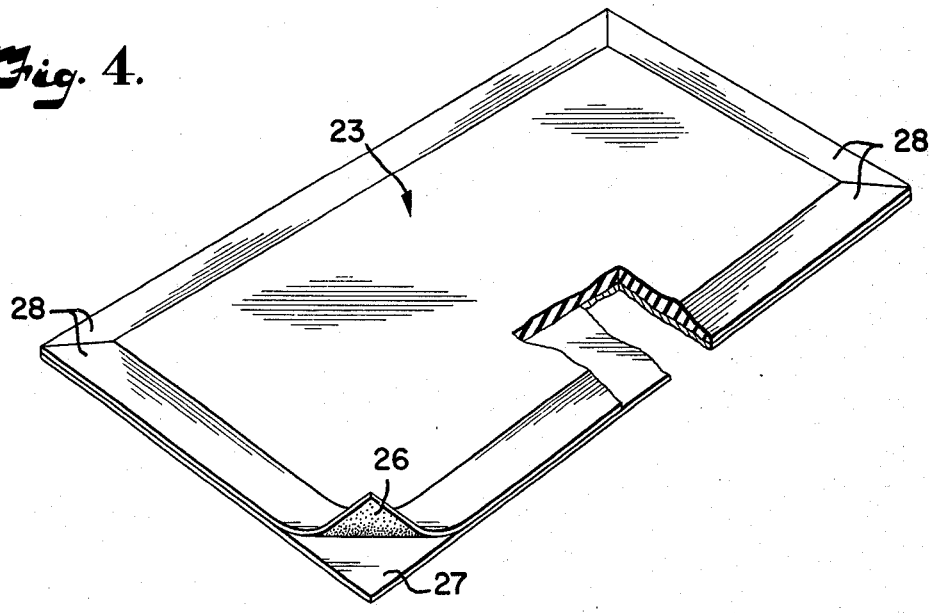
FIG. 4 is a perspective view of a protective pad with portions broken away to show the adhesive and removable cover therefor.

When the printing plates 19 are prepared for printing the sheets with a display advertisement 9 having a coupon 10 therein, a standard stereotype plate 20 is made with a series of spaced projections 21 positioned to register with the coupon border as it passes thereover. The stereotype plate 20 is made of suitable material, such as zinc or plastic and is mounted on a half-deck of the printing plate cylinder 22 of the pair 18. A backing sheet 23 for the portion of the web 12 being perforated is provided on the respective blanket cylinder 24 which cylinder has the conventional blanket 25 thereon as is used in conventional printing and the backing sheet or pad 23 is applied thereto. The backing 23 consists of a resilient pad of rubber, neoprene or the like applied to the surface of the blanket 25 on the cylinder 24 in position to be engaged by the perforating projections 21. The pad 23 is larger in area than the area defined by the projections 21, the pad preferably extending outwardly in each direction at least one inch beyond the rows of perforations. The pad 23 is of a suitable thickness to allow the perforating projection on the standard stereotype plate to perforate the sheet with only normal impression adjustments. It is preferred that the pad be of 0.008 to 0.020 inches thick, and it is preferred that the rubber stock for the pad 23 have a pressure sensitive adhesive 26 covering one face with a protective sheet 27 covering the adhesive. In this manner the desired size of the pad can be cut from a stock sheet of pad material and the position on the blanket cylinder of the pair 18 determined and then the protective cover 26 removed and the thin rubber pad 23 then adhered to the outer surface of the clean blanket 25 on the blanket cylinder 24 of the half-deck in a position to cover the coupon area. The pad 23 preferably is provided with thinned margins 28 as by beveled portions as illustrated in FIG. 4. The beveled or thinned portions permit the web 12 even with the thickened paper to move the pad without material change in the tension on the web. It is preferred that the perforations extend through the paper and therefore a rubber pad which has resiliency is used. If it is desired to have a weakened line in place of a line of perforating a harder material should be used for the pad 23. No ink is carried on the perforator plate.

The desired printing plates and stereotype plates are prepared and positioned on their respective half decks of the cylinders of the pairs of printing and blanket cylinders and then the web 12 is fed from a roll into the press which is started and operated to move the web between the printing cylinders and blanket cylinders. The first and second impressions in black from the pairs 16 and 17 are printed in the usual way. The web passes between the pair 18 of cylinders which form the perforations to define the border of the coupon 10. The sequence in which the web passes between the printing impressions and perforating step may be arranged as desired, as for example the web may pass between the pair 16 for a first printing impression and then between the pair 18 for perforating the coupon border and then between the pair 17 for a second printing impression. The rolls of paper are made ready in the normal manner and pasters are made in the usual manner. After the printing is completed the stereotype plate 20 is removed and the pad 23 is then stripped from the blanket 25 of the respective blanket cylinder 24 and then the press is ready for other printing wherein the third pair 18 of cylinders may be used for printing color, as no special equipment and no permanent modification of the press was made in the printing of the sheets and the perforating of the coupon border.

Where it is desired to have a coupon that is a return mailer, a heavier newsprint paper is used for the sheets having the pages with the display advertisement, however, such paper is run through the press in sequence with the ordinary newsprint, merely being pasted in a conventional manner with no change in the presses. The heavier newsprint paper is at least 0.006 of an inch thick with a maximum thickness preferably of 0.015 of an inch as compared to ordinary newsprint paper being approximately 0.0032 inches thick. In such an advertisement with a display portion 9 on the front face 2, the coupon portion on the back face 3 is a part of the advertisement as the coupon should be printed on both faces to be a return mailer. Such heavier newsprint is of a thickness to qualify under the postal regulations for mailing and the heavier paper can be run through the press in the normal manner and speed and pasters made as with ordinary newsprint. If color is also to be used in the printing of the pages carrying the advertisement, the same procedures as described above are followed utilizing two pairs of cylinders for printing in black, a third pair for printing in the color and a fourth pair that have the printing cylinder 22 and blanket cylinder 24, uninked and have the stereotype plate 20 and pad 23 for the perforating around the coupon 10. In all forms the coupon 10 is spaced inwardly from any edge of the newspaper page, the spacing preferably being such that there is at least one inch or more between the perforations and the sheet edge thereby overcoming any tendency of the tension on the paper web causing the web to burst after the perforations are formed.

In the form shown there is only one coupon with a perforated border on the newspaper page. There may be any number and arrangement of such coupons with the plate 20 having projections 21 arranged to register with each and a pad 23 adhered to the blanket 25 for each set of projections 21.

The newspapers are distributed in their usual manner to the subscribers and a subscriber desiring to use the coupon 10 can easily separate same from the page 5 on the lines 11 of perforation without the use of any cutting instrument or the like.

It is to be understood that while I have illustrated and described certain forms of my invention, it is not to be limited to the specific form or arrangement of parts herein described and shown.

What I claim and desire to secure by Letters Patent is:

1. A method of printing of news and advertising on a paper strip in a rotary press to form a newspaper with removable coupons or mailers separable on a tear line formed therein:

a. providing a rotary press having at least three pairs of printing plate cylinders and blanket cylinders, said blanket cylinders each having blanket thereon, and moving a web of paper to be printed between the plate cylinders and the respective blanket cylinders of each pair in sequence;

b. preparing printing plates with relief printing images thereof including a display advertisement with images for a coupon therein spaced from edges of the plates;

c. locating and securing the printing plates on the printing plate cylinders of two pairs of the plate cylinders and blanket cylinders for printing both sides of a web moved therebetween;

d. preparing a third printing plate with raised perforating members arranged to correspond to boundaries of the coupon;

e. locating the area of the blanket cylinder of the third pair that will register with the coupon on the web passing thereby;

f. providing on said area a cushion sheet larger than the coupon and adhering said cushion sheet to the blanket on the third blanket cylinder without spoiling the blanket for subsequent use as a blanket to cover and extend beyond all portions of the area of said blanket on the third blanket cylinder that registers with the coupon;

g. locating and securing the third printing plate to the printing cylinder of the third pair with the perforating members registering with boundaries of the coupon on the web passing between the third pair; and h. feeding and moving a paper web between the pairs of cylinders to print the faces of the web and perforate the web to define a tearable boundary to the coupon with the web being between the perforating members and the cushion sheet carried by the blanket when the perforations are formed.

2. The method of forming removable coupons or mailers as set forth in claim 1 including:

a. providing said cushion sheet a thickness of 0.008 to 0.020 inch and of an area to extend beyond all boundaries of the coupon defined by the perforation members;

b. bevelling edge margins of said cushion sheet to reduce the thickness of the edges thereof; and c. the adhering of the cushion sheet to said blanket on the respective blanket cylinder being by pressure sensitive adhesive which is separable for removal from the blanket of said respective blanket cylinder.

3. The method of forming removable coupons or mailers as set forth in claim 1 wherein:

a. providing a standard stereotype plate having raised perforation members in lines thereon corresponding to the coupon border for said third printing plate and positioning the same to register with the cushion sheet on the respective blanket cylinder of said third pair with the additional thickness of the cushion sheet on the respective blanket cylinder providing for said perforating plate to perforate the web with only normal impression adjustments.

4. Rotary web press apparatus for printing newspapers and the like on a paper web fed from a roll and perforating tear lines therein to define redeemable coupons and mailers comprising:

a. a rotary press having a plurality of pairs of printing plate cylinders and blanket cylinders with blankets thereon and with the web movable therebetween during a printing operation;

b. printing plates located and secured on certain of said plurality of printing plate cylinders and having relief images thereon to print desired portions of faces of the web, said images including a redeemable coupon with advertising information thereon, said coupon having a boundary with all portions thereof spaced from side edges of the web and from any page separation lines of the material printed thereon;

c. a plate located and secured to the printing plate cylinder of another pair of said plurality of printing plate cylinders and blanket cylinders and having raised perforation members thereon in lines to register with the boundaries of a coupon printed on the web as it passes between said another pair of printing plate cylinder and blanket cylinder; and d. a sheet of cushion material larger than said coupon removably adhered to the blanket of the blanket cylinder without spoiling the blanket for subsequent use as a blanket of said another pair of printing plate cylinder and blanket cylinder in registry with said coupon and said perforation members so that the web moves between the perforating members and the cushion sheet with said cushion sheet retaining the perforating members from contact with the blanket of said respective blanket cylinder.

5. Rotary web press apparatus as set forth in claim 4 wherein:

a. said cushion sheet is at least 0.008 inch in thickness;

b. said cushion sheet has one face with an adhesive coating for removably securing same to a blanket cylinder.

6. Rotary web press apparatus as set forth in claim 5 wherein:

a. said cushion sheet is formed of neoprene and is of a thickness of between 0.008 inch and 0.020 inch;

b. said adhesive coating is a pressure sensitive adhesive protected by a pull off cover prior to use.

7. Rotary web press apparatus as set forth in claim 4 wherein:

a. said cushion sheet is of a size relative to the coupon boundaries to extend therebeyond a distance in the nature of one inch on all sides;

b. said cushion sheet has an exposed face with edge margins bevelled to a substantially reduced edge thickness.

8. Rotary web press apparatus as set forth in claim 4 wherein:

a. the rotary press is of a type normally for color printing with two of the pairs of cylinders having black ink for black and white printing of the web and said another pair of cylinders being without ink and performing only the perforation of the web.

* * * * *